United States Patent [19]

Ryan

[11] Patent Number: 5,048,826

[45] Date of Patent: Sep. 17, 1991

[54] SAFETY APPARATUS FOR USE WITH BARBELL ASSEMBLY

[76] Inventor: William C. Ryan, 553 Bellevue Ave., #15, Newport, R.I. 02840

[21] Appl. No.: 560,801

[22] Filed: Aug. 23, 1990

[51] Int. Cl.[5] ..... A63B 21/078

[52] U.S. Cl. ..... 272/123; 272/DIG. 5; 272/DIG. 6

[58] Field of Search ..... 272/93, 116, 117, 118, 272/123, 125, 129, 130, 134, 143, 144, DIG. 4, DIG. 5, DIG. 6

[56] References Cited

U.S. PATENT DOCUMENTS

| | | | |
|---|---|---|---|
| 4,253,662 | 3/1981 | Podolak | 272/123 |
| 4,540,171 | 9/1985 | Clark et al. | 272/118 |
| 4,709,922 | 12/1987 | Slade, Jr. et al. | 272/117 X |
| 4,949,959 | 8/1990 | Stevens | 272/123 |
| 4,998,721 | 3/1991 | Adders et al. | 272/118 |

*Primary Examiner*—Robert Bahr

*Attorney, Agent, or Firm*—Salter & Michaelson

[57] ABSTRACT

A safety apparatus for use with a barbell assembly includes a support frame, a pair of cables which are securable to opposite ends of the barbell assembly, a winch assembly on the support frame for retracting and releasing the cables, a pair of tension sensors for sensing the tension in the cables, a velocity sensor for sensing the speed and direction of movement of at least one of the cables and a controller for controlling the operation of the winch assembly. The controller is responsive to the tension sensors and the velocity sensor for normally releasing and retracting the cables during a weight lifting routine so that the safety apparatus is normally unnoticeable to a weightlifter. The controller is also responsive to the sensors for detecting an abnormal condition during an exercise routine and it is operative in responsive to an abnormal condition for taking control of the barbell assembly to reduce the risk of injury to the weightlifter.

9 Claims, 3 Drawing Sheets

SAFETY APPARATUS FOR USE WITH BARBELL ASSEMBLY

BACKGROUND AND SUMMARY OF THE INVENTION

The instant invention relates to exercise equipment and more particularly to a safety apparatus for use with a barbell assembly.

It has generally been found that barbell assemblies can be effectively utilized in various exercise programs for increasing both the stamina and overall muscle strength of weightlifters. However, because it is also possible for weightlifters to sustain serious physical injuries during weight lifting exercises, it is important that proper safety procedures be followed during such exercises. In this regard, it has been found that one of the most common and effective techniques for weightlifters to increase overall muscle strength is to repetitively lift a predetermined weight until the weightlifter's muscles have reached a point of nearly complete exhaustion. However, for safety reasons it has been found that in order for a weightlifter to carry out an exercise of this type, it is generally necessary for the weightlifter to engage the assistance of a spotter to observe the weightlifter during his or her exercise program so that the observer can render assistance if the weightlifter loses control of a barbell assembly. However, it has been found that it is often inconvenient for a weightlifter to obtain a spotter before commencing a repetitive weight lifting exercise of this type. Further, it has been found that as a result, in many instances weightlifters have either disregarded proper safety procedures and carried out weight lifting exercises without the use of spotters or they have been forced to abandon their plans to carry out certain types of exercise routines.

The instant invention provides an effective apparatus for enabling a weightlifter to safely and effectively carry out many types of weight lifting exercises without the use of a spotter. Specifically, the instant invention provides a safety apparatus for use with a barbell assembly for assisting a weightlifter in the event that he or she loses control of the barbell assembly. Still more specifically, the safety apparatus of the instant invention comprises a pair of cables which are securable to a barbell assembly, a support assembly for supporting the cables at a pair of spaced locations above the barbell assembly and a winch for selectively longitudinally retracting and releasing the cables. The safety apparatus further comprises tension sensing means for determining the tension in the cables relative to predetermined upper and lower threshold tension values, velocity sensing means for sensing the speed and direction of longitudinal travel of the cables, and a control means responsive to the tension sensing means and the velocity sensing means for controlling the operation of the winch. Specifically, the control means is operative for controlling the winch for maintaining the tension in the cables at levels which are between the upper and lower threshold tension values unless the speed of travel of at least one of the cables in a release direction exceeds a predetermined velocity threshold value, in which case the control means is operative for controlling the winch for increasing the tension in the cables to levels above the upper threshold tension value. The cables preferably include rings which are receivable on opposite ends of a barbell assembly for supporting the barbell assembly in a substantially horizontal disposition. The control means is preferably operative for controlling the winch to stop the travel of the cables in a release direction in the event that the speed of travel of at least one of the cables in a release direction exceeds the predetermined threshold velocity value. Further, the control means is preferably operative for returning the barbell assembly to a predetermined rest elevation in the event that the speed of travel of at least one of the cables in a release direction exceeds the predetermined threshold velocity value and the barbell assembly is below the rest elevation. Still further, the control means is preferably operative for controlling the winch to stop the advancement of the cables in a release direction in the event that the tension in one of the cables falls below the lower threshold tension value while the tension in the other cable is greater than the upper threshold tension value. The control means is preferably still further operative for returning the barbell assembly to the predetermined rest elevation in the event that the barbell assembly is below the rest elevation and the tension in one of the cables falls below the lower threshold tension value while the tension in the other cable is greater than the upper threshold tension value.

It has been found that the safety apparatus of the instant invention can be effectively utilized for assisting a weightlifter in performing certain barbell-type exercise routines. Specifically, it has been found that the safety apparatus of the instant invention can be utilized for taking over control of a barbell assembly in the event that a weightlifter reaches a point where he or she is unable to control the barbell assembly. In this regard, because the control means is operative for controlling the winch for taking over control of a barbell assembly in the event that the tension in one of the cables falls a predetermined amount below a threshold tension value while the tension in the other cable is above the threshold tension value, the apparatus is operative for taking control of the barbell assembly when the bar thereof becomes tilted. Further, because the safety apparatus is operative for taking control of a barbell assembly when the rate of advancement of one of the cables in a release direction exceeds a predetermined velocity value the safety apparatus is operative for taking control of the barbell assembly in the event that the barbell assembly begins to fall. Still further, because the apparatus is operative for taking control of a barbell assembly when the distance travelled by the barbell assembly during a predetermined time interval falls below a predetermined threshold distance value, the safety apparatus is operative for taking control of the barbell assembly when a weightlifter becomes stalled in one position during a weight lifting exercise.

Accordingly, it is a primary object of the instant invention to provide a safety apparatus for use with a barbell assembly.

Another object of the instant invention is to provide a safety apparatus which is operative for taking control of a barbell assembly in the event that a weightlifter is unable to control the barbell assembly.

Another object of the instant invention is to provide a safety apparatus which is operative for enabling a weightlifter to safely perform an exercise routine utilizing a barbell assembly without the use of a spotter.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
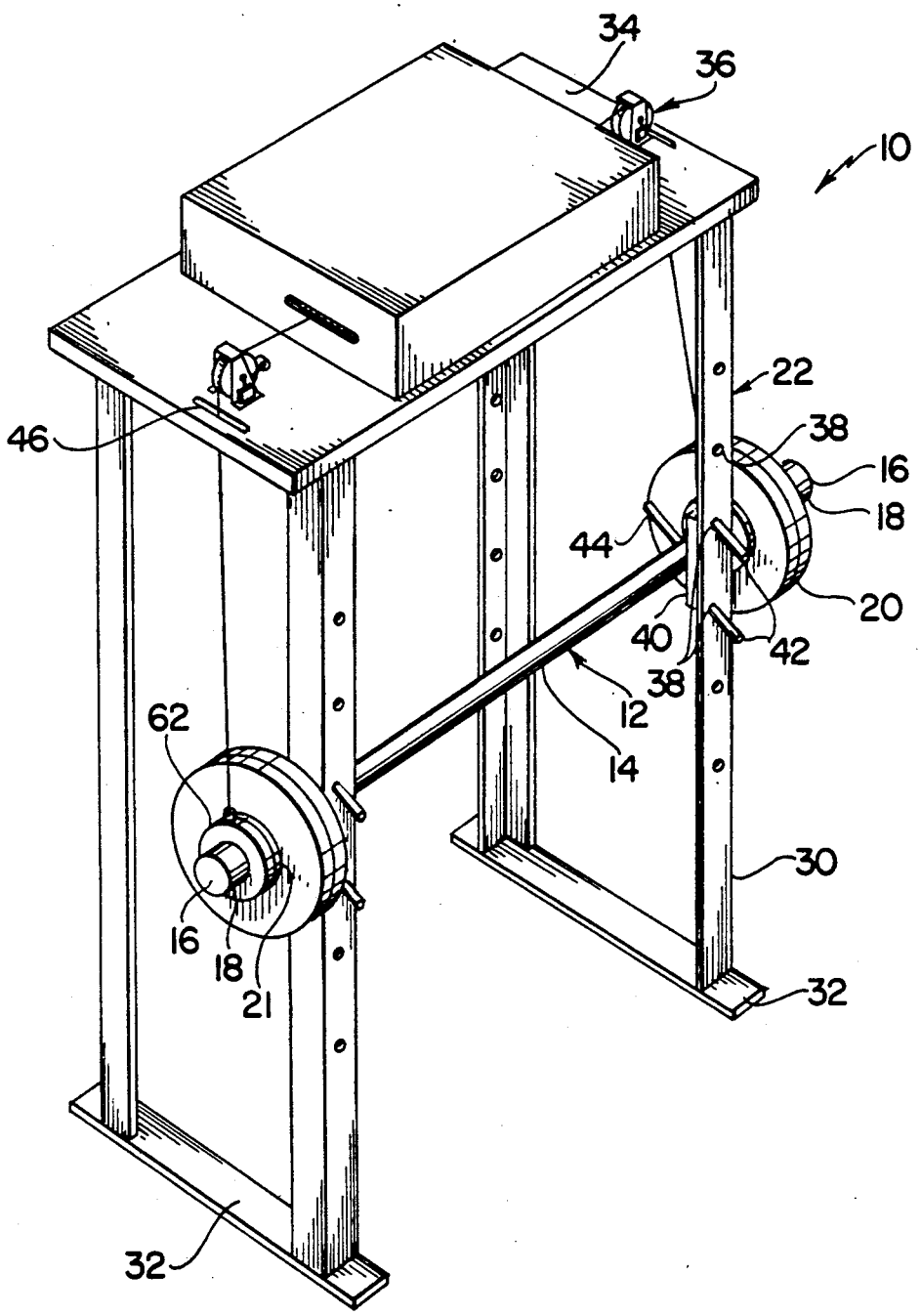
FIG. 1 is a perspective view of the apparatus of the instant invention.
Figure 2:
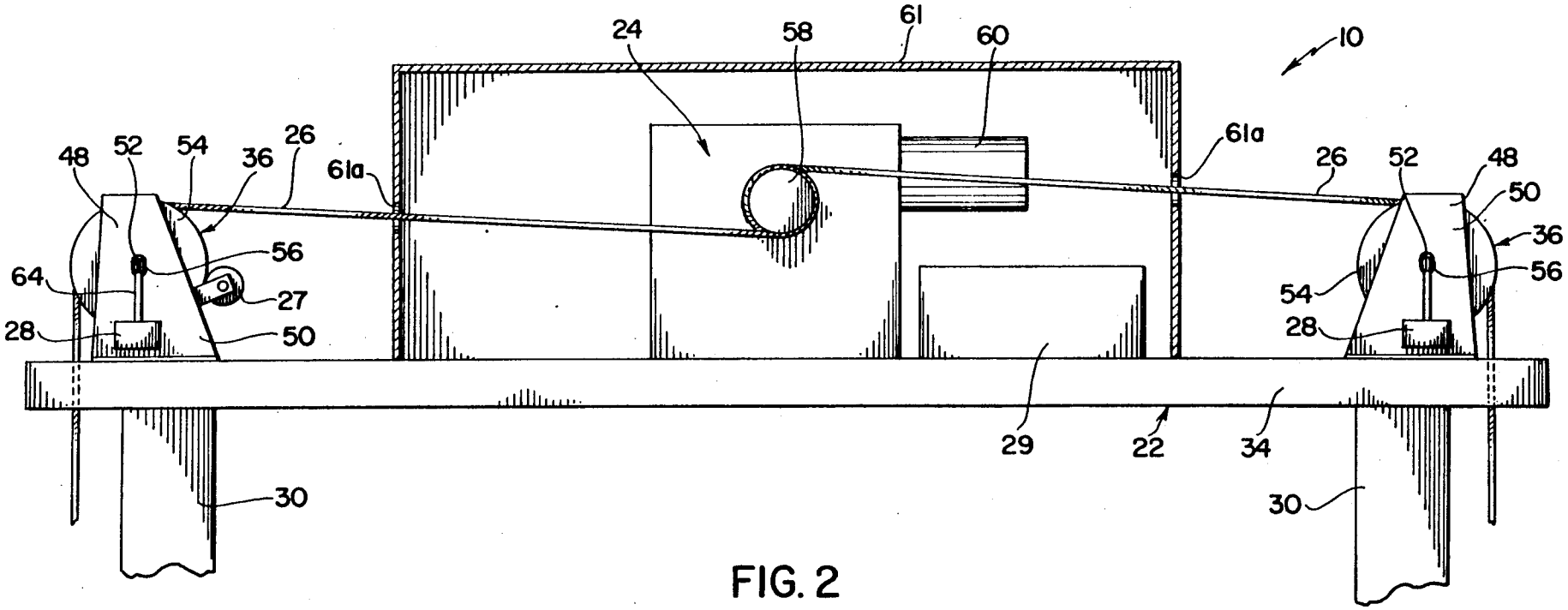
FIG. 2 is a fragmentary front elevational view thereof.
Figure 3:
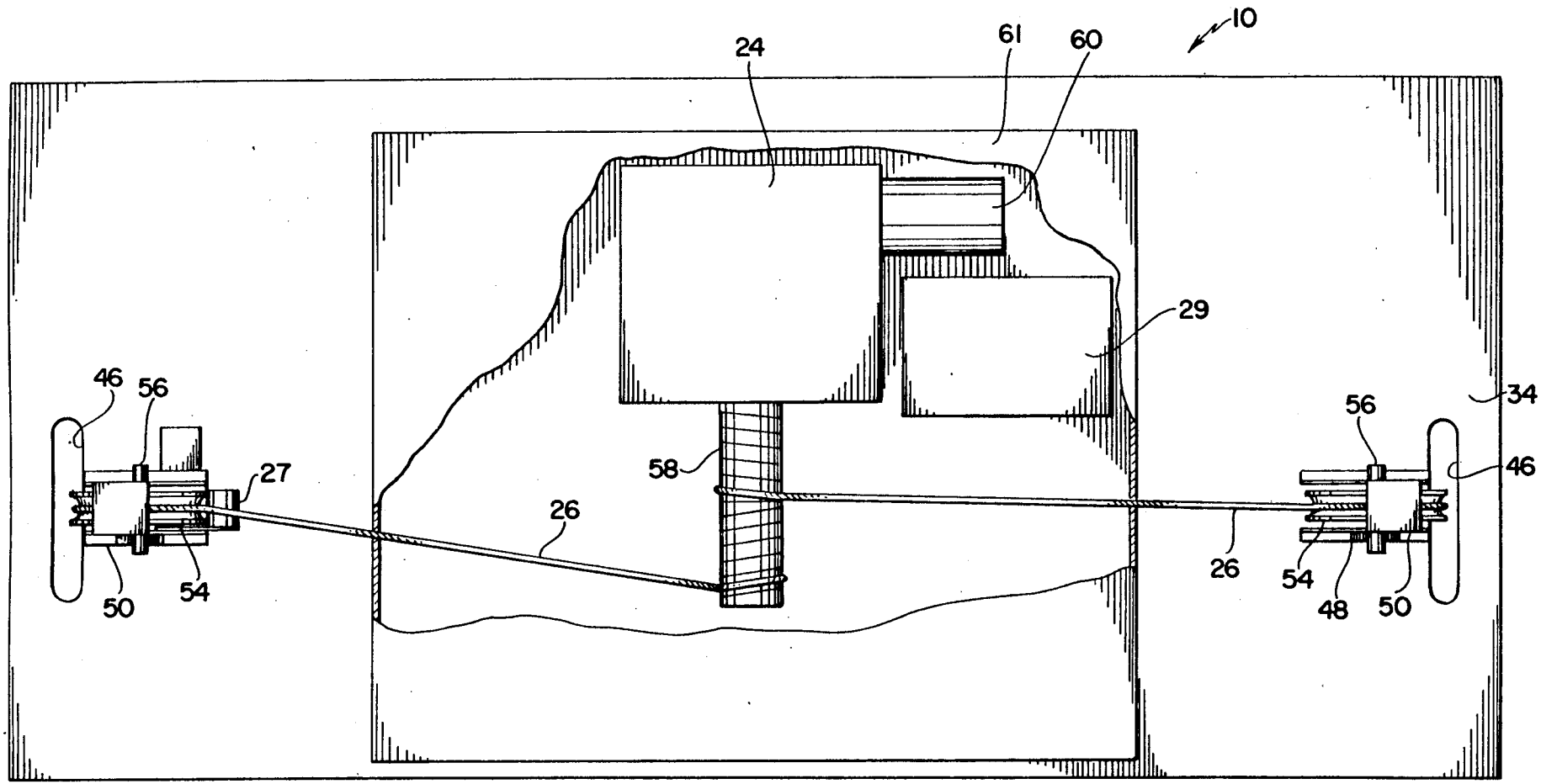
FIG. 3 is a fragmentary top plan view thereof.

Referring now to the drawings, the apparatus of the instant invention is illustrated in FIGS. 1-3 and generally indicated at 10. The apparatus 10 is operative for assisting a weightlifter in the use of a barbell assembly generally indicated at 12 by taking over control of the barbell assembly 12 in the event that the weightlifter reaches a point where he or she is unable to effectively control the barbell assembly 12.

The barbell assembly 12 is of conventional construction and it comprises a cross bar 14 having opposite terminal ends 16 and opposite terminal end portions 18, and a plurality of weights 20 which are received on the cross bar 14 in inwardly spaced relation to the terminal ends 16 thereof, the weights 20 being retained in position by retaining collars 21.

The apparatus 10 comprises a support assembly generally indicated at 22, a winch assembly generally indicated at 24, a pair of cables 26, a velocity sensor 27, a pair of tension sensors 28 and a controller 29. The cables 26 are received on the winch 24 so that the winch 24 is selectively operative for retracting and releasing the cables 26. The winch assembly 24 is mounted on the support assembly 22 and the cables 26 extend downwardly in spaced relation from the support assembly 22 to the end portions 18 of the barbell assembly 12. The controller 29 is operative for normally controlling the winch assembly 24 to apply a predetermined minimal tension level, such as a one-pound of tension, to each of the cables 26 so that the tension applied to the barbell assembly 12 by the cables 26 is normally unnoticeable to a weightlifter during a weight lifting exercise routine. However, the controller 29 is responsive to the velocity sensor 27 and the tension sensors 28 for sensing an abnormal condition in the weightlifter's exercise routine. In response to such an abnormal condition the controller 29 is operative for controlling the winch assembly 24 to return the barbell assembly 12 to a predetermined rest elevation.

The support assembly 22 comprises a plurality of vertical angle members 30 which are assembled on supporting bases 32, an upper support platform 34 on the upper ends of the vertical angle members 30 and a pair of pulley assemblies generally indicated at 36. The vertical angle members 30 each have a plurality of apertures 38 formed therein and a barbell support bracket 40 is received in a pair of the apertures 38 in each of the front vertical angle members 30. The brackets 40 are of conventional construction and each comprises a pair of angularly downwardly extending support legs 42 which are receivable in a pair of adjacent apertures 38 and an angularly upwardly extending barbell support arm 44. The top plate 34 has a pair of rearwardly extending slots 46 therein which are disposed adjacent opposite side ends of the top plate 28, as illustrated, and the pulley assemblies 36 are mounted on the top plate 34 adjacent the slots 46. Each of the pulley assemblies 36 comprises a frame 48 including a pair of spaced substantially vertically disposed walls 50 each having a vertically elongated aperture 52 therein. Each of the pulley assemblies 36 further comprises a pulley 54 which is mounted on a shaft 56 received in the apertures 52 in the frame 48 thereof. The pulleys 54 are rotatably mounted on the shaft 56 and because of the elongated configuration of the apertures 52 the pulleys 54 are vertically moveable slightly relative to their respective frames 48.

The winch assembly 24 is of conventional construction and it includes a winch shaft 58 which is rotatable by means of a motor 60. As illustrated in FIG. 2, the cables 26 are attached to the winch shaft 58 for retracting the cables 26 when the winch shaft 58 is rotated in a counter clockwise direction and for releasing the cables 26 when the winch shaft 58 is rotated in a clockwise direction.

The cables 26 comprise conventional steel cables and they have rings 62 on the terminal ends thereof which are receivable on the end portions 18 of the barbell assembly 12 for releasably securing the barbell assembly 12 to the apparatus 10.

The velocity sensor 27 comprises a digital optical encoder which is operative for sensing the speed and direction of rotation of the adjacent pulley 54 in order to determine the speed and direction of travel of the respective cable 26 thereon. The velocity sensor 27 is connected to the controller 29 for supplying velocity information thereto.

The tension sensors 28 each comprise a mechanical pressure switch which includes an upwardly biased plunger portion 64. The plunger portion 64 of each of the sensors 28 is biased to a position of engagement with the respective shaft 56 thereof and each of the pressure switches 28 further includes two pairs of internal electrical contacts (not shown), one pair of which is moved to a closed position when the downward force on the respective plunger element 64 thereof falls below approximately one pound and the other pair of which is moved to a closed position where the downward force on the respective plunger element thereof falls a predetermined further amount below approximately one pound. In other words, when the tension level in either of the cables 26 is above a predetermined upper threshold tension level of approximately one pound, both pairs of the internal contacts in the respective sensor 28 thereof are maintained in open positions, whereas when the tension level in either of the cables 26 falls below the upper threshold tension level of approximately one pound, one pair of the internal contacts in the respective tension sensor 28 thereof are moved to a closed position. When the tension falls a predetermined further amount below one pound to a predetermined lower threshold tension level, the second pair of contacts are moved to a closed position. The tension sensors 28 are electrically connected to the controller 29 for providing an indication of whether or not the tension in one or both of the cables 26 is above or below the predetermined upper and lower threshold tension levels.

The controller 29 comprises a conventional microcontroller, such as an Intel 8087 microcontroller and it is programmable by conventional programming techniques for performing the functions herein described. Specifically, the controller 29 is responsive to the opening and closing of the electrical contacts in the tension sensors 28 for normally maintaining tension levels of slightly less than approximately one pound in each of the cables 26 by controlling the motor 60 to rotate the winch shaft 58. The controller 29 is further operative for retracting the cables 26 to take control of the barbell assembly 12 in the event that an abnormal situation occurs during a weight lifting exercise as detected by the tension sensors 28 and the velocity sensor 27. Specifically, in the event that the position of the barbell assembly 12 as determined from the velocity information supplied by the velocity sensor 27 is below a normal at rest position (normally at the elevation of the brackets 40) and the tension in one of the cables 26 rises to a level above approximately the one pound upper threshold tension level while the tension in the other cable 26 is below the lower threshold tension level, the controller 29 is operative for controlling the winch 24 for retracting the cables 26 to raise the barbell assembly 12 to the level of the brackets 40. Hence, in the event that the barbell assembly 12 is lifted unevenly so that the bar 14 is positioned in an angular disposition and the tension in one of the cables 26 rises to a level above the upper threshold tension level, the apparatus 10 is operative for taking control of the barbell assembly 12 and for returning the barbell assembly 12 to the rest elevation. Further, in the event that the barbell assembly 12 is below the predetermined rest elevation and the rate of upward or downward movement of the barbell assembly 12 as detected by the velocity sensor 27 falls below a predetermined lower limit for a set period of time, such as three seconds, the controller 29 is operative for controlling the winch 24 to retract the barbell assembly 12 to the predetermined rest elevation. Still further, in the event that the barbell assembly 12 is below the predetermined rest elevation and the rate of travel of the cables 26 in a release direction exceeds a predetermined maximum threshold velocity level, the controller 29 is operative for controlling the winch 24 to retract the cables 26 to return the barbell assembly 12 to the rest elevation. Accordingly, in the event that a weightlifter becomes stalled or looses control of the barbell assembly 12 during a weight lifting exercise, the apparatus 10 is operative for taking control of the barbell assembly 12 and for returning it to the normal at rest position.

It is seen therefore that the instant invention provides an effective apparatus for assisting a weightlifter during a weight lifting exercise. The apparatus 10 is adapted so that it is transparent to a weightlifter during a normal weight lifting exercise by maintaining a substantially constant tension level of slightly less than approximately one pound in each of the cables 26 during normal conditions. However, in the event that an abnormal situation is detected in the weightlifters exercise routine, the controller 29 is operative for actuating the winch 24 to retract the cables 26 to return the barbell assembly 12 to an at rest position wherein it can be easily placed onto the brackets 40. Accordingly, the apparatus 10 can be effectively utilized for enhancing the safety of a weight lifting exercise and it can be utilized in place of a spotter during most weight lifting exercises. As a result, it is seen that the apparatus of the instant invention represents a significant advancement in the art relating to exercise equipment which has substantial commercial potential.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A safety apparatus for use in connection with a barbell assembly comprising:

a. cable means securable to said barbell assembly;

b. support means for supporting said cable means at a point above said barbell assembly so that said cable means normally extends upwardly from said barbell assembly to said support means;

c. winch means actuatable for selectively longitudinally retracting and releasing said cable means;

d. tension sensing means for determining the tension in said cable means relative to predetermined upper and lower threshold tension values;

e. velocity sensing means for sensing the speed and direction of longitudinal travel of said cable means relative to said winch means; and f. control means responsive to said tension sensing means and said velocity sensing means for controlling said winch means to normally maintain the tension in said cable means between said upper and lower threshold tension value unless the speed of travel of said cable means in a release direction exceeds a predetermined threshold velocity value, said control means controlling said winch means for increasing the tension in said cable means to a level above said upper threshold tension value in the event that the speed of travel of said cable means in a release direction exceeds said predetermined threshold velocity value.

2. In the safety apparatus of claim 1, said cable means comprising a pair of cables which are securable to said barbell assembly at horizontally spaced locations, said support means comprising first and second support elements for supporting said cables at horizontally spaced locations above said barbell assembly to enable said cables to be utilized for supporting said barbell assembly in a substantially horizontal disposition below said support means, said winch means being operative for simultaneously selectively longitudinally retracting and releasing both of said cables, said tension sensing means being operative for independently sensing the tension in each of said cables relative to said upper and lower threshold tension values, said velocity sensing means being operative for sensing the speed and direction of longitudinal travel of at least one of said cables relative to the respective support element thereof, said control means being responsive to said tension sensing means for controlling said winch means to maintain the tension in at least one of said cables between said upper and lower threshold tension values unless the speed of travel of at least one of said cables in a release direction as sensed by said velocity sensing means exceeds said predetermined threshold velocity value, said control means controlling said winch means for increasing the tension in said cables to levels above said upper threshold tension value in the event that the speed of travel of at least one of said cables in a release direction as sensed by said velocity sensing means exceeds said predetermined threshold velocity value.

3. In the safety apparatus of claim 2, said cable means further comprising a ring on each of said cables, said rings being receivable on opposite ends of said barbell assembly for supporting the latter in a substantially horizontal disposition.

4. In the safety apparatus of claim 1, said control means further characterized as being operative for controlling said winch means to stop the travel of said cable means in a release direction in the event that the speed of travel of said cable means in a release direction exceeds said predetermined threshold velocity value.

5. In the safety apparatus of claim 2, said control means further characterized as being operative for controlling said winch means to stop the travel of said cables in a release direction in the event that the speed of travel of at least one of said cables in a release direction exceeds said predetermined threshold velocity value.

6. In the safety apparatus of claim 2, said control means further characterized as being operative for returning said barbell assembly to a predetermined rest elevation in the event that the speed of travel of at least one of said cables in a release direction exceeds said predetermined threshold velocity value and said barbell assembly is below said rest elevation.

7. In the safety apparatus of claim 1, said control means further characterized as controlling said winch means for returning said barbell assembly to a predetermined rest elevation in the event that the distance traveled by said barbell assembly during a predetermined time interval is less than a predetermined threshold distance value and said barbell assembly is located below said rest elevation.

8. In the safety apparatus of claim 2, said control means being operative for controlling said winch means to stop further travel of said cable means in a release direction in the event that the tension in one of said cables as sensed by said cable sensing means falls below said lower threshold tension value while the tension in the other of said cables is greater than or equal to said upper threshold tension value.

9. In the safety apparatus of claim 8, said control means being operative for controlling said winch means for returning said barbell assembly to a predetermined rest elevation in the event that said barbell assembly is below said rest elevation and the tension in one of said cables as sensed by said cable sensing means falls below said lower threshold tension value while the tension in the other of said cables is equal to or greater than said upper threshold tension value.

* * * * *